US007275527B2

(12) United States Patent
Bruchner et al.

(10) Patent No.: US 7,275,527 B2
(45) Date of Patent: Oct. 2, 2007

(54) METHOD AND APPARATUS FOR VENTING A CRANKCASE OF AN INTERNAL COMBUSTION ENGINE

(75) Inventors: Klaus Bruchner, Ebersbach (DE); Ralf Kaufmann, Stuttgart (DE); Rudolf Klein, Weinstadt (DE); Mario Mürwald, Ebersbach (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 11/328,723

(22) Filed: Jan. 10, 2006

(65) Prior Publication Data

US 2007/0028903 A1 Feb. 8, 2007

Related U.S. Application Data

(63) Continuation-in-part of application No. PCT/EP2004/007276, filed on Jul. 3, 2004.

(30) Foreign Application Priority Data

Jul. 11, 2003 (DE) ..... 103 31 344

(51) Int. Cl.
*F01M 13/00* (2006.01)

(52) U.S. Cl. ..... 123/572

(58) Field of Classification Search ..... 123/572–574
See application file for complete search history.

(56) References Cited

U.S. PATENT DOCUMENTS

| | | | | |
|---|---|---|---|---|
| 3,175,546 | A * | 3/1965 | Roper | 123/572 |
| 3,589,347 | A | 6/1971 | Sawada et al. | |
| 4,760,833 | A * | 8/1988 | Tatyrek | 123/574 |
| 5,542,401 | A * | 8/1996 | Newarski | 123/572 |
| 5,964,207 | A * | 10/1999 | Clauss et al. | 123/572 |
| 6,405,721 | B1 * | 6/2002 | Moren | 123/572 |
| 6,457,462 | B2 * | 10/2002 | Moren | 123/572 |
| 2002/0056423 | A1 * | 5/2002 | Yamaki et al. | 123/90.11 |

FOREIGN PATENT DOCUMENTS

| | | |
|---|---|---|
| DE | 197 09 910 | 9/1998 |
| DE | 197 34 001 | 2/1999 |
| DE | 199 29 876 | 1/2001 |
| DE | 100 18 209 | 10/2001 |
| DE | 101 53 120 | 9/2002 |
| DE | 201 18 388 | 4/2003 |
| DE | 101 63 781 | 7/2003 |
| EP | 0 220 886 | 5/1987 |
| EP | 1 411 216 | 4/2004 |

* cited by examiner

*Primary Examiner*—Marguerite McMahon
(74) *Attorney, Agent, or Firm*—Klaus J. Bach

(57) ABSTRACT

In a method for venting a crankcase of an internal combustion engine, in which, in a first operating range under part-load, the crankcase is vented via a first venting line, which opens into an intake line of the internal combustion engine downstream of a throttle valve, and in a second operating range under full load engine operation, the crankcase is vented via a second venting line, which opens into the intake line upstream of the throttle valve, the first venting line includes a control valve and a central unit is provided which operates the control valve so as to control the flow of vent gases through the first venting line over a range including a complete flow interruption under engine overrun condition to prevent venting gases from reaching the engine exhaust system when the internal combustion engine is operating in an overrun mode.

7 Claims, 3 Drawing Sheets

Overrun Supercharging

Naturally aspirated operation

METHOD AND APPARATUS FOR VENTING A CRANKCASE OF AN INTERNAL COMBUSTION ENGINE

This is a Continuation-In-Part Application of International Application PCT/EP2004/007276 filed Jul. 3, 2004 and claiming the priority of German application 103 31 344.3 filed Jul. 11, 2003.

BACKGROUND OF THE INVENTION

The invention relates to a method and an apparatus for venting a crankcase of an internal combustion engine wherein, during partial load engine operation, the crankcase is in communication with the engine intake duct downstream of a throttle valve and, during full load engine operation the crankcase is in communication with the intake duct upstream of the throttle valve.

When reciprocating-piston internal combustion engines are operating, pressure fluctuations occur in the crankcase as a result of the piston movements. The pressure of blow-by gases is superimposed on these pressure fluctuations. Blowby gases primarily comprise combustion gases which during combustion are formed at high pressure in the combustion chamber and pass via the piston ring seals into the crankcase. An excessively high pressure in the crankcase reduces the efficiency of the reciprocating-piston internal combustion engine and entails the risk of lubricating oil escaping outward via shaft seals. A pressure which is too low may cause unfiltered air from the environment to enter the crankcase, leading to increased wear caused by dirt particles. Furthermore, the acid-forming exhaust gas constituents $NO_x$ and $SO_x$ which are contained in the blow-by gases react with water to form acids. To prevent corrosion within the internal combustion engine, the acids have to be neutralized by basic additives in the oil which is present in the crankcase. During this process, the additives are consumed, leading to the ageing of the oil and the formation of a slurry, which means that relatively short oil change intervals have to be adhered to.

For the reasons which have been outlined, the reciprocating-piston internal combustion engines have an apparatus for venting the crankcase; to protect the environment from pollutants, the venting gases are introduced into the intake system. To prevent too much oil and too many dirt particles from entering the intake system, an oil separator is provided in the venting line between the crankcase and the intake system.

DE 197 09 910 C2 discloses a crankcase venting arrangement for an internal combustion engine, in which the crankcase is connected to the intake system via a venting line, which opens out into an induction pipe of the internal combustion engine downstream of a throttle valve. An oil separator and a static throttle, which limits the quantity of gas sucked out of the crankcase, is arranged in the venting line. The throttle may also be a dynamic throttle, in the form of a valve. The venting line is used to vent the crankcase in particular when the internal combustion engine is operating under part-load, when the pressure downstream of the throttle valve is relatively low. Furthermore, there is a second venting line with an oil separator which opens into the intake system upstream of the throttle valve. This second venting line is active in particular when the internal combustion engine is operating under full load when the throttle valve is approximately fully open and the pressure drop at the throttle valve is correspondingly low. If the throttle valve is increasingly closed in the part-load range, the pressure drop at the throttle valve rises, so that fresh air is drawn into the crankcase via the second venting line, with the result that the blow-by gases are purged out of the crankcase by the fresh air via the first venting line.

The blow-by gases also contain unburned hydrocarbons, which are largely completely burnt during the subsequent combustion operation and therefore do not enter the exhaust system. Unburned hydrocarbons in the blow-by gases cannot be burnt in the internal combustion engine is in an overrun or engine braking mode with an excess of air and are instead converted in catalytic converters which may be provided in the exhaust system, which represents an unnecessary burden on the catalytic converters.

US 2003/106543 discloses a crankcase venting arrangement for a turbocharged internal combustion engine. In this case, during naturally aspirated operation of the internal combustion engine, the crankcase is vented via a first venting line, which opens out into an intake line of the internal combustion engine downstream of a throttle valve. During the supercharging of the internal combustion engine by means of an exhaust gas turbocharger, the first venting line is closed by means of a non-return valve, while a second venting line connects the crankcase to the intake side of the compressor. The first and second venting lines branch off from a common venting line section. To ensure that no air is sucked in by the internal combustion engine from the induction side of the compressor via the second and first venting lines during naturally aspirated operation, the second venting line is closed by a non-return valve during naturally aspirated operation.

It is the object of the present invention to protect an exhaust gas catalytic converter of an internal combustion engine from high loading by unburned hydrocarbons.

SUMMARY OF THE INVENTION

In a method for venting a crankcase of an internal combustion engine, in which, in a first operating range under part-load, the crankcase is vented via a first venting line, which opens into an intake line of the internal combustion engine downstream of a throttle valve and, in a second operating range under full load engine operation, the crankcase is vented via a second venting line, which opens into the intake line upstream of the throttle valve. The first venting line includes a control valve and a control unit is provided which operates the control valve so as to control the flow of vent gases through the first venting line over a range including a complete flow interruption during engine overrun phases to prevent venting gases from reaching the engine exhaust system when the internal combustion engine is operated in the overrun mode.

In this way, the first venting line, which is used to vent the crankcase during part-load operation of the internal combustion engine, is closed when the internal combustion engine is operating in the overrun mode. This prevents blow-by gases from passing via the intake system and the combustion chamber into the exhaust system and therefore to the exhaust-gas catalytic converter, where the hydrocarbons, which are not burnt in the combustion chamber in the overrun mode, in particular with the fuel injection switched off, would unnecessarily burden the exhaust-gas catalytic converter. It is expedient for the crankcase venting to be controlled as a function of the pressure difference between the pressure in the crankcase and the pressure in the intake line. The first venting line, which is used for part-load venting, is closed if the differential pressure drops below a predetermined value which is characteristic of the drive changing to an overrun mode in the naturally aspirated engine range. Such a value for the pressure difference is, for example, −600 mbar.

In the full-load range, when the throttle valve is open to its maximum extent, the pressure difference between the intake line and the crankcase is so low that no significant volumetric flow passes via the throttle into the first venting line. The crankcase is then vented via the second, unthrottled venting line, which opens out into the intake line upstream of the throttle valve. If the internal combustion engine is operating with supercharging, it is advantageous for the first venting line to be closed in the supercharged mode.

The method according to the invention is expediently carried out by an apparatus which comprises a control valve in the first venting line. This control valve may also be an electromagnetic control valve, e.g. a proportional control valve or a cyclically actuable control valve. The control valve opens the first venting line according to the stipulations of the method. For this purpose, it is expediently actuated by an electronic control unit of the internal combustion engine as a function of relevant characteristic variables, characteristic curves or characteristic diagrams, which are measured by sensors, stored in memories and/or calculated. It is for this purpose possible to use characteristic variables which are also used for overrun cutoff of the internal combustion engine and/or a transmission control of a motor vehicle.

Another advantage of a valve which is actuated electrically, for example, by a control unit of an internal combustion engine, is that fuel which has accumulated in the engine oil, which can occur during operation as a result of frequent cold starts and/or high proportions of full load operation, is only fed to the combustion chamber, for example via an induction pipe, if it does not have any significant influence on the combustion air ratio, i.e. for example in the case of active lambda control.

In situations without active lambda control, for example immediately after starting, while the internal combustion engine is warming up or under full load, the part-load venting quantity can be limited by the control valve or even switched off. During mix adaptation by the control unit of the internal combustion engine, the part-load venting can be switched off, so that any fuel fractions which are present from the engine oil cannot distort the measured values.

Furthermore, in the event of changing differential pressures between induction pipe and crankcase, for example when passing through the part-load range to a higher load, it is possible to open up a larger cross section of the venting line, so that an increased volumetric flow of fresh air is passed through the crankcase, which can lead to an improvement in the oil quality over the engine running time.

A necessary diagnosis can be carried out, for example, during lambda operation with the tank venting inactivated, and if it is detected that a valve is stuck open, it is then possible to reduce the power of the internal combustion engine, so that the internal combustion engine is not damaged. Furthermore, the fault can be indicated to the driver. If a proportional control valve is used, the diagnosis can be carried out by displacement measurement of a closure element of the valve by means of a displacement sensor. Finally, the proportion of fuel which passes into the intake system via the crankcase venting can be taken into account in the fuel metering.

According to one configuration of the invention, in the first venting line there is a control valve with a throttle and a control piston, which is arranged axially displaceably in a control cylinder. The pressure of the crankcase acts on the first end face of the control piston, and a spring and the pressure in the intake line act on the second end face downstream of the throttle valve. On account of the differential pressure and as adapted by the control spring, the control piston opens a first control opening in the outlet from the throttle in a suction operating range outside the overrun operating range and closes this control opening in the overrun operating range, in which the internal combustion engine is working without driving torque and, generally without any fuel injected being injected into the combustion chamber. If the internal combustion engine is operating with supercharging, the control piston closes a second control opening in the inlet to the throttle and therefore blocks the venting gas flow through the throttle.

The invention will become more readily apparent from the following description of an exemplary embodiment thereof on the basis of the accompanying drawings:

DESCRIPTION OF AN EXEMPLARY EMBODIMENT

Figure 1:
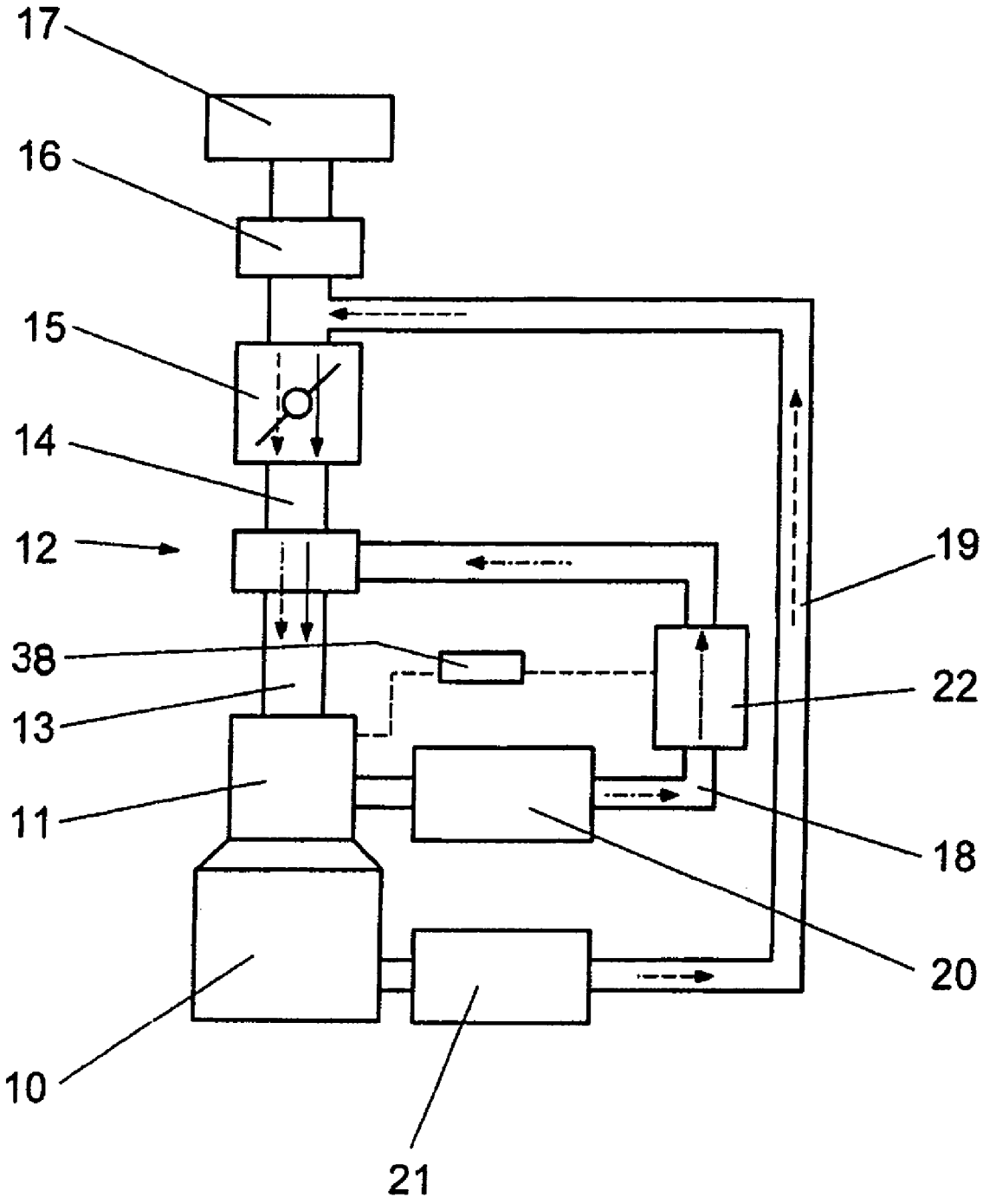
FIG. 1 shows diagrammatically a structure of an apparatus according to the invention.

A crankcase 10 and a cylinder block 11 of a reciprocating-piston internal combustion engine are connected to one another in such a way that the pressure between them is substantially balanced. A first venting line 18, in which an oil separator 20 and, downstream of the latter, a control valve 22 are arranged, leads from the cylinder block 11. The first venting line 18, which is used to vent the crankcase 10 in a first, that is, part-load, operating range of the internal combustion engine opens into an intake line 14 of an intake system 12 downstream of a throttle valve 15. The intake line 14 is connected to an induction pipe 13 which is arranged on the cylinder block 11. The pressure in the induction pipe 13 substantially corresponds to the pressure in the intake line 14 downstream of a throttle valve 15.

A second venting line 19, in which another oil separator 21 is arranged, extends from the crankcase 10 to the intake line 14 upstream of the throttle valve 15. An air mass flow meter 16 and an air filter 17 are provided in the intake line 14 upstream of the connecting point of the second venting line 19. The flow in lines 14, 18, 19 is indicated by arrows, and specifically the flow of the blow-by gases during part-load operation is indicated by arrows in dot-dashed lines, the flow of the blow-by gases in full-load operation is indicated by arrows in dashed lines and the flow of the fresh air is indicated by arrows in solid lines.

The control valve 22 is expediently an electromagnetically actuated valve, e.g. a proportional control valve, the cross section of flow of which is controlled by an electronic control unit 38 of the internal combustion engine 10, 11 as a function of operating parameters. The valve 22, in accordance with the stipulations of the control unit 38, blocks the through-flow in overrun mode or in supercharged mode of operation of the internal combustion engine 10, 11 or opens or throttles the through-flow in a desired part-load range of the naturally aspirated mode 30.

The control valve 22 may also be an electrically actuable cyclical valve, the flow through which, in open operation, is determined by the opening intervals of the control cycle predetermined by the control unit 38.

Figure 2:
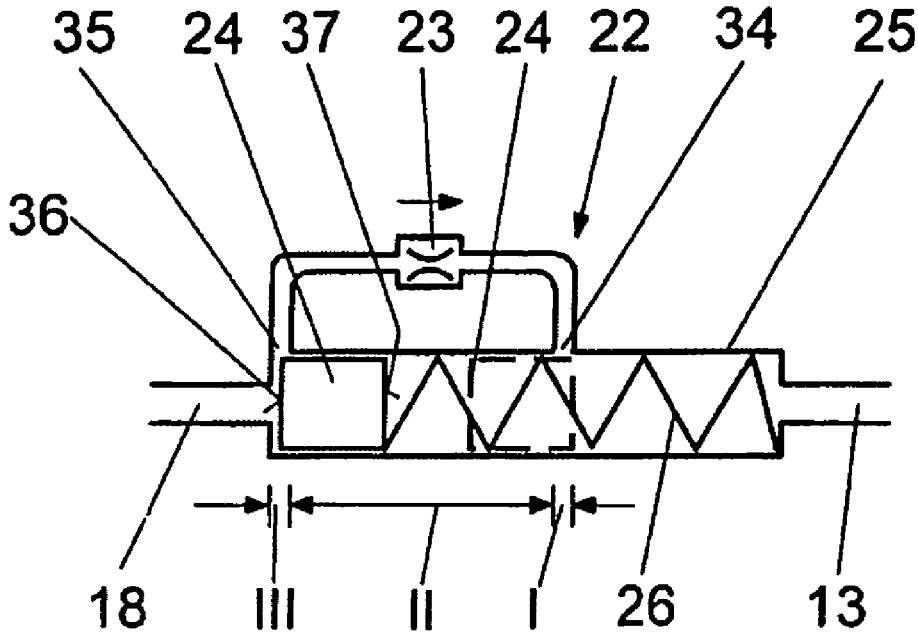
FIG. 2 shows a diagrammatic longitudinal section through a control valve.

In the case of the mechanical embodiment shown in FIG. 2, the control valve 22 has a control piston 24 which is arranged axially displaceably in a control cylinder 25. The control cylinder 25 has connections to the upstream venting line 18 and to the intake line 14 downstream of the throttle valve 15 or to the induction pipe 13. Therefore, a first end face 36 of the control piston is acted on by the pressure in the crankcase 10 or in the cylinder block 11, while an opposite second end face 37 of the control piston 24 is acted on by a spring 26 and the pressure which is present in the induction pipe 13. The control cylinder 25 has two control openings 34, 35, of which a first control opening 34 is located in the outlet from the throttle 23 and a second control opening 35 is located in the inlet to the throttle 23.

Figure 3:
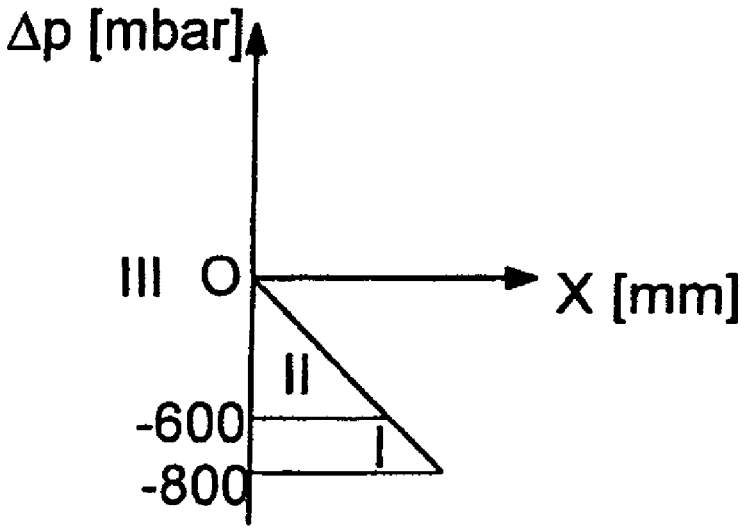
FIG. 3 shows a diagram of a differential pressure $\Delta p$ between a crankcase and an intake line downstream of a throttle valve.

In overrun mode 32 (FIG. 4), in which the engine torque M plotted against the engine speed n has the profile indicated by the characteristic curve 31 and is negative, the control piston 24 adopts a position indicated by dashed lines, since on account of the low pressure in the intake line 14 of between −800 to −600 mbar (FIG. 3), the pressure difference between the crankcase 10 and the pressure in the intake pipe 13 is so great that the force of the control spring 26 is overcome. Therefore, no volumetric flow occurs via the first venting line 18. A characteristic curve 33 (FIG. 5) shows the profile of the volumetric flow V plotted against the pressure difference.

Figure 4:
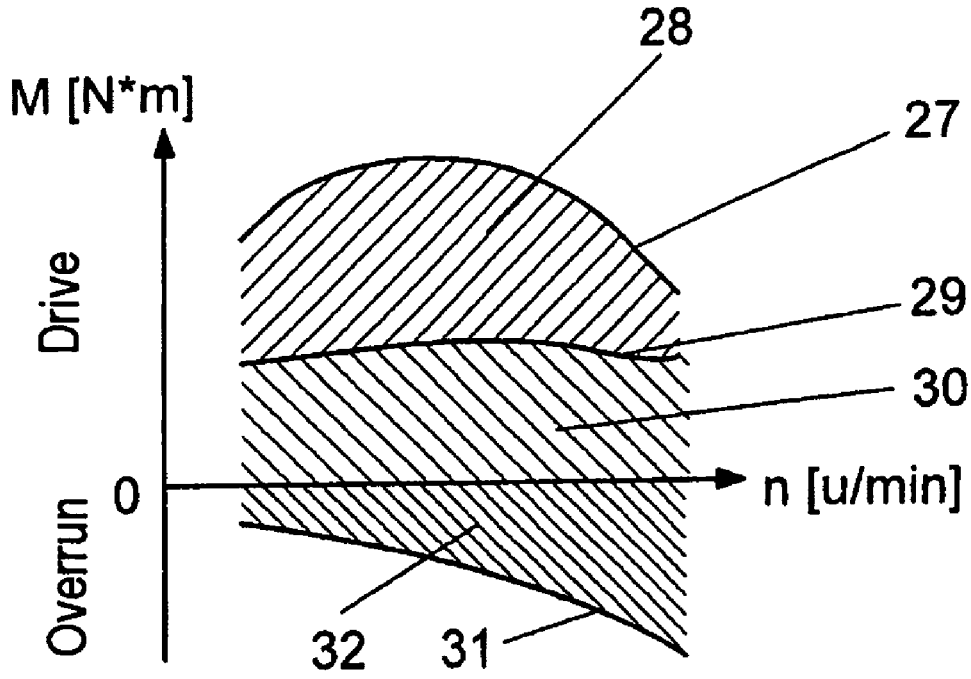
FIG. 4 shows a characteristic diagram of a torque M of the internal combustion engine plotted against the engine speed n.
Figure 5:
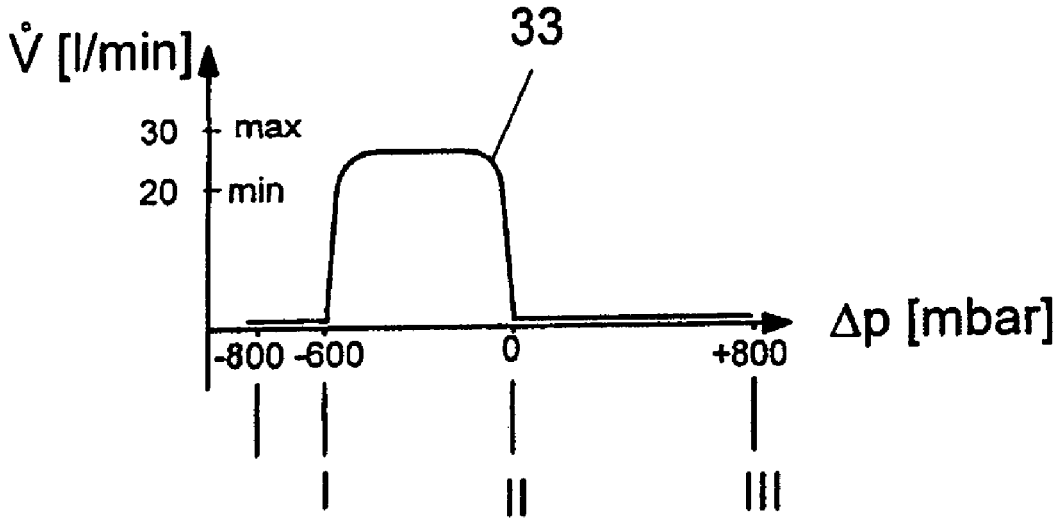
FIG. 5 shows a diagram for a volumetric flow V.

Whereas in the overrun mode the engine torque M is negative, in the driving mode it becomes positive (FIG. 4). The naturally aspirated operating range 30 in the driving range is delimited in the direction of full load by a characteristic curve 29. In this range, the control piston 24 is located between the two control openings 34 and 35 (FIG. 2), so that a volumetric flow V flows across the throttle 23 in accordance with the characteristic curve 33 and vents the crankcase 10 in the part-load range. In this case, volumetric flows of between 20 and 30 l/min are achieved. If the internal combustion engine 10, 11 is operated with supercharging, the control piston 24, in the supercharged range 28, is displaced to the end of the control cylinder 25, so that it closes the second control opening 35 and thereby blocks the flow through the first venting line 18. The supercharging range 28 is delimited in the direction of the maximum torque by the characteristic curve 27.

What is claimed is:

1. A method for venting a crankcase (10) of an internal combustion engine with an intake line (14) including a throttle valve (15), said method comprising the steps of venting the crankcase (10) in a first operating range under part-load engine operation via a first venting line (18) which includes a control valve (22) and which opens out into the intake line (14) of the internal combustion engine downstream of the throttle valve (15), venting, in a second operating range under full load, the crankcase (10) via a second venting line (19), which opens out into the intake line (14) upstream of the throttle valve (15), controlling the volumetric flow through the first venting line (18) by the control valve (22) disposed in the first venting line (18) as a function of relevant characteristic variables, characteristic curves or characteristic diagrams in a range including a complete interruption of the vent flow through the first venting line (18), and closing the first venting line (18) when the internal combustion engine (10, 11) is operating in an overrun mode (32).

2. The method as claimed in claim 1, wherein the first venting line (18) is closed when the pressure difference (Δp) between the ambient pressure and the pressure in the intake line (14) downstream of the throttle valve (15) drops below a predetermined value.

3. The method as claimed in claim 1, wherein the first venting line (18) is closed when the internal combustion engine (10, 11) is operating in a supercharged mode (28).

4. An apparatus for venting a crankcase (10) of an internal combustion engine (10, 11) having an intake line (14) with a throttle valve (15) for supplying intake air to the engine, said apparatus including a first venting line (18) extending from the engine to the intake line (14) downstream of the throttle valve (15), a second venting line (19) extending from the engine to the intake line (14) upstream of the throttle valve (15), an electromagnetic control valve (22) arranged in the first venting line (19) and an electronic valve control unit (38) of the internal combustion engine (10, 11) for operating the electronic control valve (22) as a function of relevant characteristic variables, characteristic curves or characteristic diagrams for controlling the volumetric flow through the first venting line (18) from the engine (10, 11) to the intake line (14) downstream of the throttle valve (15), so as to close the electronic control valve (22) when the internal combustion engine is in an engine overrun mode or in a supercharged operating mode.

5. The apparatus as claimed in claim 4, wherein the control valve (22) is cyclically actuable.

6. The apparatus as claimed in claim 4, wherein the control valve (22) is a proportional control valve which includes a closure member with a displacement sensor.

7. An apparatus for venting a crankcase (10) of an internal combustion engine (10, 11) having an intake line (14) with a throttle valve (15) for supplying intake air to the engine, said apparatus including a first venting line (18) extending from the engine to the intake line (14) downstream of the throttle valve (15), a second venting line (19) extending from the engine to the intake line (14) upstream of the throttle valve (15), including a control valve having a control cylinder (25) with a control piston (24) arranged axially displaceably in the control cylinder (25) with a first end face (36) exposed to the pressure of the crankcase (10) and a second end face (37) on which a spring (26) acts and which is exposed to the pressure in the intake line (14) downstream of the throttle valve (15), the control piston (24) opening up a first control opening (34) in the outlet from the throttle (23) in a suction operating range (30) outside an overrun operating range (32) and closing this first control opening (34) in the overrun operating range (32), while in the super-charged operating range (28) the piston closes a second control opening (35) in the inlet to the throttle (23) and therefore blocks the flow through the throttle (23).

* * * * *